United States Patent [19]

Stoecker

[11] Patent Number: 4,841,691

[45] **Date of Patent: *Jun. 27, 1989**

[54] MOBILE HOME SKIRTING SYSTEM

[76] Inventor: Don R. Stoecker, Georgetown Lake, Anaconda, Mont. 59711

[21] Appl. No.: 187,566

[22] Filed: Apr. 28, 1988

[*] Notice: The portion of the term of this patent subsequent to Jul. 21, 2004, has been disclaimed.

[51] Int. Cl.[4] ..... E02D 27/00

[52] U.S. Cl. ..... 52/169.12; 52/DIG. 3; 52/645

[58] Field of Search ..... 52/DIG. 3, 169.12, 645

[56] References Cited

U.S. PATENT DOCUMENTS

| | | | |
|---|---|---|---|
| 3,256,655 | 5/1966 | Teeter . | |
| 3,313,081 | 4/1967 | Squire | 52/645 |
| 4,001,361 | 1/1977 | Unruh | 52/169.12 X |
| 4,010,963 | 3/1977 | Prentice | 52/169.12 X |
| 4,043,088 | 8/1977 | Payton | 52/DIG. 3 X |
| 4,112,638 | 11/1978 | Hanson, Sr. . | |
| 4,352,261 | 10/1982 | Wargo . | |
| 4,549,378 | 10/1985 | Ayers et al. . | |
| 4,680,904 | 7/1987 | Stoecker . | |

FOREIGN PATENT DOCUMENTS

| | | | |
|---|---|---|---|
| 945327 | 4/1974 | Canada | 52/DIG. 3 |

*Primary Examiner*—David A. Scherbel
*Assistant Examiner*—Lan Mai
*Attorney, Agent, or Firm*—Henderson & Sturm

[57] ABSTRACT

A framework for extending around the lower periphery of a trailer house of mobile home, including corner posts and intermediate posts which are adjustable in length. Upper, lower and intermediate links interconnect the upstanding corner posts with the intermediate posts to form a framework. Plywood, sheet metal or other converings are then connected to the framework to seal the area below the trailer house from the outside atmosphere.

3 Claims, 3 Drawing Sheets

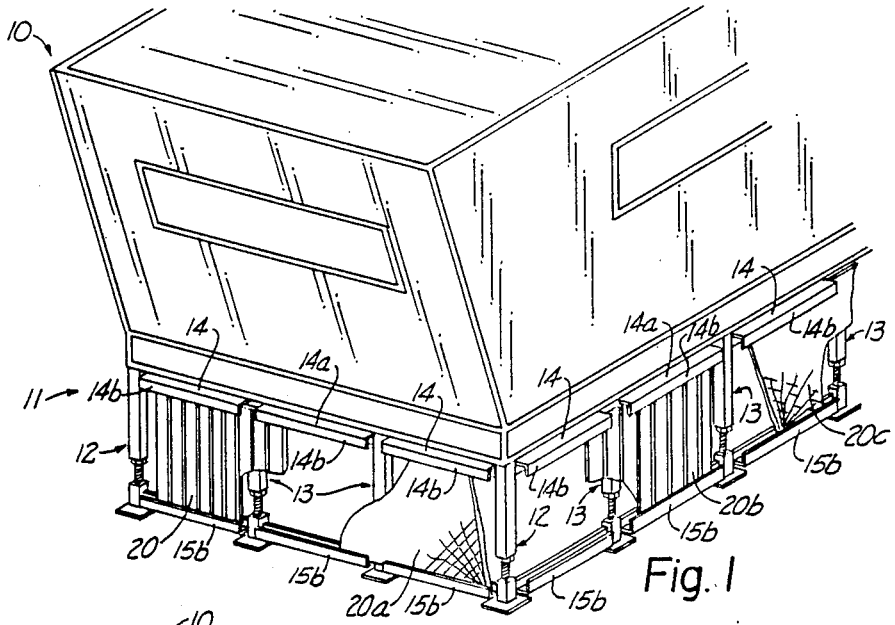
Fig. 1
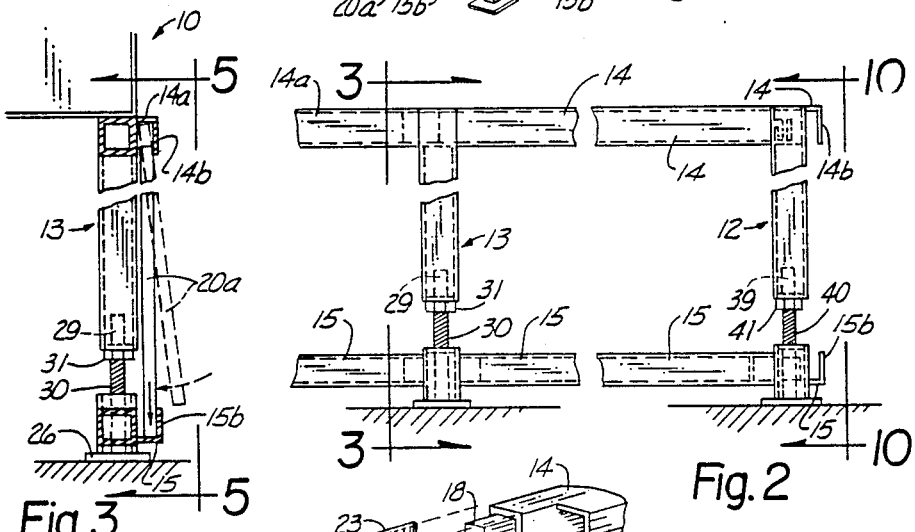
Fig. 3
Fig. 2
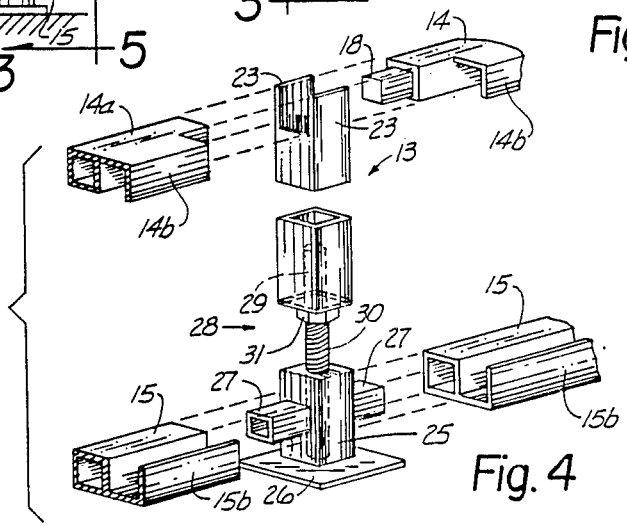
Fig. 4

MOBILE HOME SKIRTING SYSTEM

TECHNICAL FIELD

The present invention relates to a mobile home skirting system and more particularly to such a system which is portable and easily assembled and disassembled when the mobile home is moved from place to place.

BACKGROUND ART

Skirting systems have been used for many years around mobile homes or trailer houses for the purpose of insulating the trailer from outside temperature changes and also for improving the appearance of the mobile home or trailer house. Certain of these structures such as that shown in U.S. Pat. No. 4,352,261 to Wargo and U.S. Pat. No. 4,549,378 to Ayers et al., tend to be more or less of a permanent configuration used in situations where the mobile home or trailer house is not moved very often. A problem is that these types of structures are not very suitable for the situation where a trailer house is moved quite often, such as when a construction site moves from place to place or when the owner tends to move a mobile home from place to place fairly often.

U.S. Pat. Nos. 3,256,655 to Teeter and 4,112,638 to Hanson tend to be somewhat more portable than the aforementioned structures, but still have certain shortcomings.

U.S. Pat. No. 4,680,904 to Stoecker, which is incorporated herein by reference, discloses a versatile framework for use in supporting a skirt for a mobile home.

DISCLOSURE OF THE INVENTION

The present invention relates generally to a trailer skirting apparatus including a corner post disposed under each exterior corner of the mobile home, each of the corner posts including a main housing having four planar sides, a first side having a pair of openings therein spaced apart by a predetermined distance, and a second side, perpendicular to the first side. The second side also has a pair of openings spaced apart by such predetermined distance. A base member is adapted to contact the ground and has a threaded member engaging a bottom portion of the main housing and extending through a top portion of the base member. The threaded member has a nut whereby selectively rotating the nut on the threaded member selectively lengthens or shortens the effective distance between the main housing and the base member. Square tubular extension members extend from the first and second sides of the base member.

Intermediate posts are disposed between each of the corner posts and are in most respects very similar to the corner post structure. Top, bottom and intermediate horizontally disposed links are provided for interconnecting the corner posts with the intermediate posts. A covering is provided for extending around the entire lower portion of the mobile home and structures provided for selectively attaching or detaching the top and bottom of the covering to the top and bottom horizontally disposed lengths.

Upper and lower flanges on the top and bottom horizontally disposed links respectively permit rigid sheets of plywood, press board sheet metal, etc. to be easily lifted into the upper flanges and then dropped into the lower flange. The flanges then hold the sheets in the proper position.

An object of the present invention is to provide an improved portable trailer skirting apparatus.

Another object of the present invention is to provide a trailer skirting apparatus which is easily installed or disassembled and reinstalled for use at a different location.

A further object of the present invention is to provide a trailer skirting apparatus which uses various types of rigid coverings, such as wood or sheet metal.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a trailer house having the present invention installed thereon, with portions of the covering broken away for clarity and showing optional sheets of aluminum, plywood, tongue and groove boards and press boards.;

FIG. 2 is a front view of the frame of the trailer skirting apparatus;

FIG. 3 is a cross sectional view taken along line 3—3 of FIG. 2;

FIG. 4 is an exploded perspective view of one of the intermediate posts and the links that interconnect thereto;

BEST MODE FOR CARRYING OUT THE INVENTION

Figure 5:
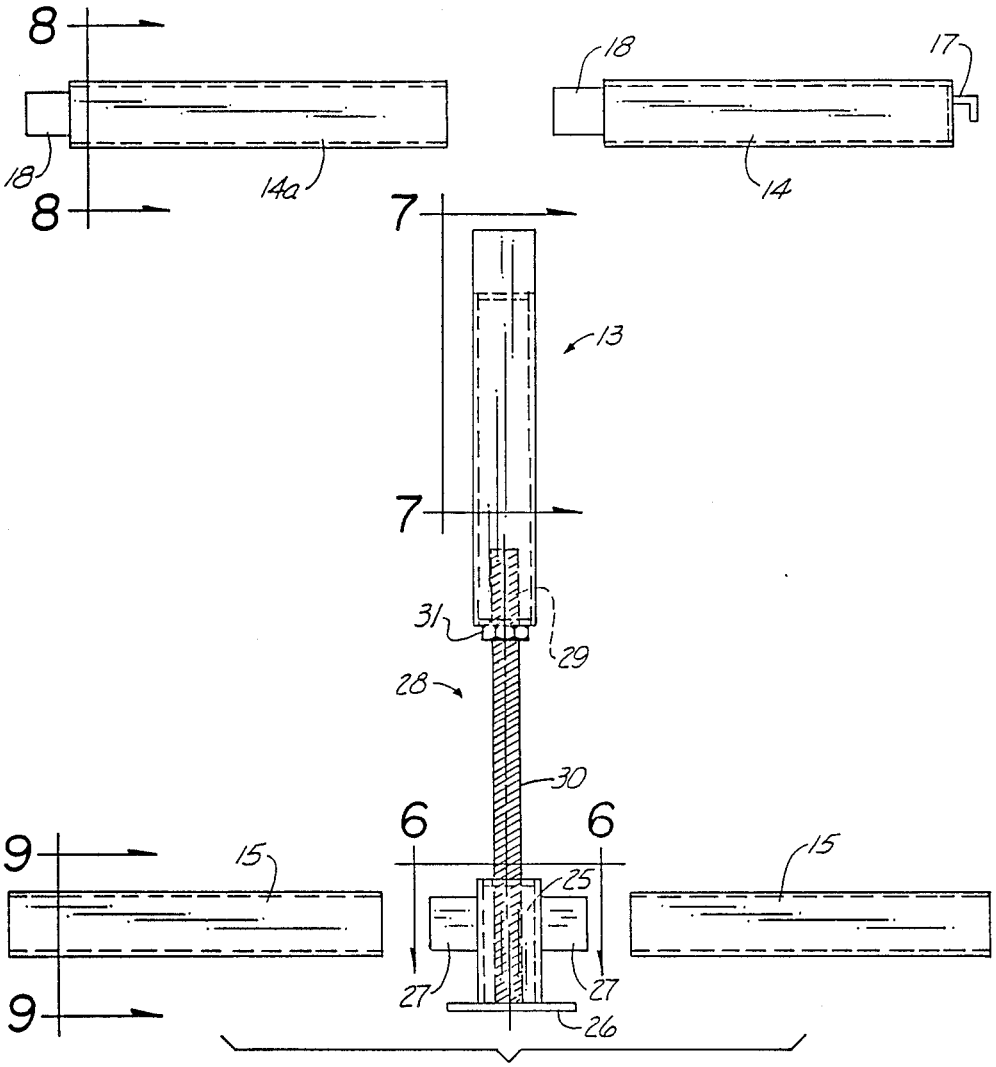
FIG. 5 is a side elevational exploded view of the structure shown in FIG. 4.
Figure 7:
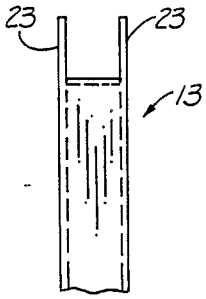
FIG. 7 is a view taken along line 7—7 of FIG. 5.
Figure 6:
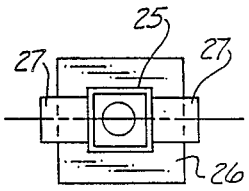
FIG. 6 is a view taken along line 6—6 of FIG. 5.

Referring now to the drawings, wherein like reference numerals designate identical or corresponding parts throughout the several views, Fig. 1 shows a trailer house (10) having a portable trailer skirting apparatus attached around the lower periphery thereof.

Figure 8:
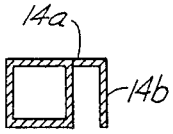
FIG. 8 is a cross sectional view taken along line 8—8 of FIG. 5.
Figure 8A:
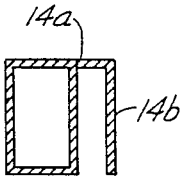
FIG. 8*a* shows an optional configuration for the top horizontal link shown in FIG. 8.
Figure 9:
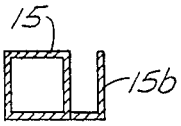
FIG. 9 is a cross sectional view taken along line 9—9 of FIG. 5.

The framework of the portable trailer skirting apparatus (11) includes corner post structures (12) and intermediate post structures (13). Top horizontally disposed links (14 and 14*a*), bottom horizontally disposed links (15) are used to interconnect the corner post (12) and the intermediate post (13), for example as shown in FIG. 2. The top links (14) have hooks (17) on one end thereof and a tubular projection (18) on the other end thereof. The hooks (17) are identical to the hooks (17) on intermediate links (16). Upper flanges (14*b*) attached to the upper or top links (14 and 14*a*) and similar lower flanges (15*b*) are evenly spaced and rigidly attached to the bottom links (15) as can readily be seen in FIGS. 8, 8*a* and 9.

Referring now to FIG. 4, it is noted that the intermediate post (13) has upper flanges (23) disposed thereon for receiving the top links (14) therein when the projection (18) of link (14) is telescoped into the open end of link (14*a*). A base housing (25) having a ground engaging plate (26) welded to the bottom thereof also has a pair of flanges (27) extending in opposite directions therefrom for sliding into the open ends of the bottom links (15) for holding the bottom links (15) in place and also for preventing them from turning around their longitudinal axis. An extension rod (28) is slidably disposed through opening (43) in base housing (25) and the bottom thereof rests and rotates on plate (26). The upper portion (29) of threaded rod (30) slides freely into an opening (42) in the bottom of top links (12 and 13). A hex-shaped nut (31) threadably engages threaded rod (30), which has right hand threads completely along the length thereof. When a wrench is attached to the nut (31) and turned in one direction, the nut (31) will move upwardly on the shaft (30) to push links (12 or 13) upwardly, and when the nut (31) is rotated in the other rotary direction, the intermediate post (13) will move downwardly with respect to the base member (25) as the nut (31) moves down on the shaft (30). Consequently, the height of the post (13) can easily be adjusted to conform to irregularities in the ground and also to different heights of trailer houses or mobile homes.

Figures 10, 11:
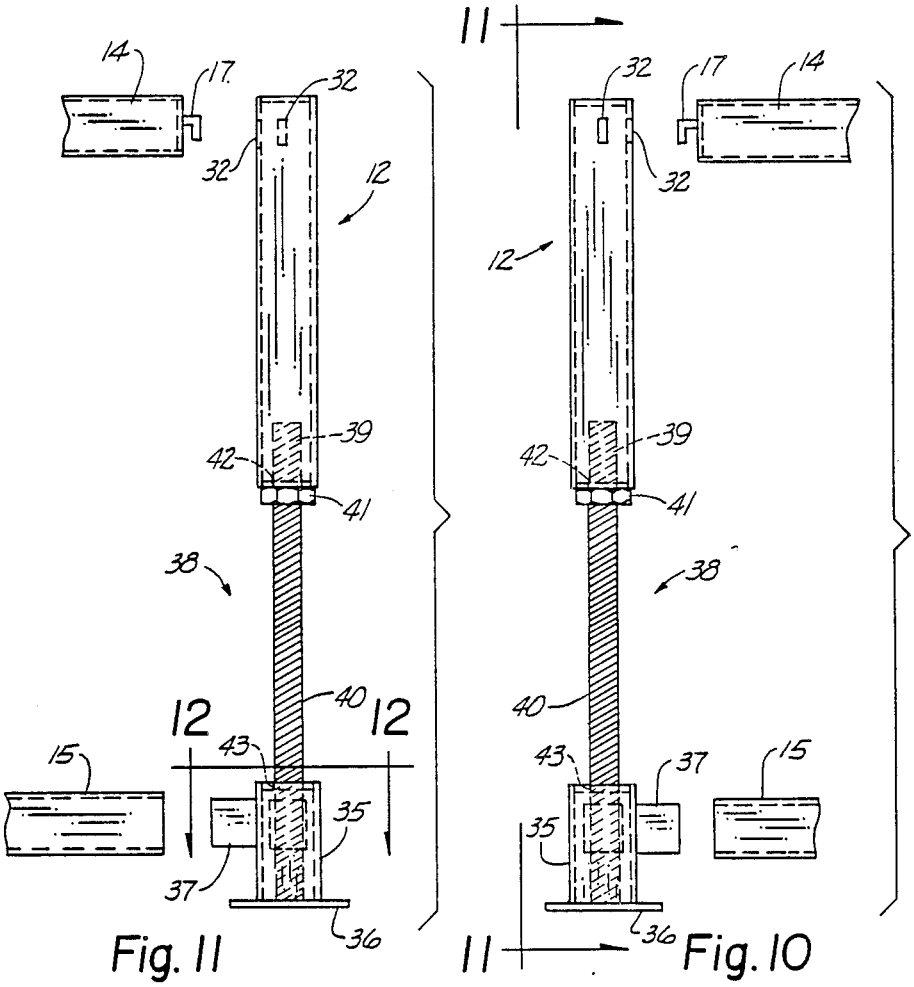
FIG. 10 is a side elevational exploded view of one of the corner post sections.
FIG. 11 is a view taken along line 11—11 of FIG. 10.
Figure 12:
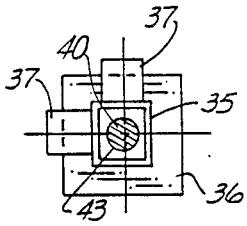
FIG. 12 is a view taken along line 12—12 of FIG. 11.

Referring now to FIGS. 10–12, it is noted that the corner posts (12) have a plurality of openings (32) therein for receiving the hooks (17) on links (14). These corner posts (12) include a base member (35) having a lower plate (36) welded thereto for contact with the ground. Square tubular extension members (37) are welded to the base member (35) and telescope into the openings in bottom links (15).

A threaded member (38) has right hand threads (39) along the entire length thereof. A hex-shaped nut (41) is used just as nut (31) is used in the FIG. 4 embodiment. The corner post (12) can be extended to be longer or shortened by rotating the threaded nut (41) in one rotary direction or the other by attaching a wrench to the hex nut (41). It is noted that the opening (42) in the lower end of corner post (12) is large to allow the rod (40) to freely move up or down therein through openings (42), and the bottom of rod (40) is free to rotate through opening (43) in tube (35). The bottom of rod (40) rotates on the top of plate (36).

The framework is set up, for example as shown in FIG. 1, by interconnecting the vertical corner post (12) with the vertical intermediate post (13) and having the top and bottom horizontally disposed links (14, 14*a* and 15) interconnected thereto. Also, each of the base members is adjusted to provide the proper height of the corner or intermediate post. Once that has been done, then sheets of aluminum (20), plywood (20*a*), tongue and groove boards (20*b*), press board (20*c*) or the like are first pushed up behind flange (14*b*) as shown in FIG. 3 in dashed lines at (20*a*). Then the bottom of the sheets (20*a*) is swung in behind flange (15*b*) and allowed to drop down behind flange (15*b*). Because the length of sheet (20*a*) is long enough to extend behind both flanges (14*b* and 15*b*), it is then held from falling out. Of course, to remove the sheet (20*a*) when the mobile home is moved again, the sheet (20*a*) is raised, the bottom swung out to the dashed line position of FIG. 3 and it is then lowered out from behind flange (14*b*). By placing sheets (20, 20*a*, 20*b* or 20*c*) all the way around the mobile home in a like fashion, the skirt consequently encloses the lower portion of the trailer house (10). Usually only one type of sheet is used for any one mobile home. FIG. 1 merely shows alternate types of sheets which can be used.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the claims, the invention may be practiced otherwise than as specifically described.

I claim:

1. Apparatus for enclosing the underside of a mobile home comprising:

a corner post disposed under each exterior corner of said mobile home, each of said corner posts comprising a main housing having four sides, a first side having a pair of openings therein spaced apart by a predetermined distance and a second side, perpendicular to said first side, said second side also having a pair of openings spaced apart by said predetermined distance and a base member adapted to contact the ground, a threaded member engaging a bottom portion of said main housing said threaded member extending into said corner post, a threaded nut means disposed on the threaded member for selectively lengthening or shortening the effective distance between said main housing and said base member, and square tubular extension means extending from first and second sides of said base member thereof;

an intermediate post disposed between each of said corner posts, each of said intermediate posts comprising an elongated housing having the top end in abutment with a bottom portion of said mobile home, a base housing adapted to contact the ground and an extension rod rotatably disposed therein, the bottom of said elongated housing resting on a threaded nut threadably engaging said extension rod, whereby rotating said threaded nut effectively shortens or lengthens the distance between said elongated housing and said base housing, said elongated housing having a pair of spaced holes therein on each of a first and a second side thereof, said first and second sides of said elongated housing being parallel to each other, and said base housing having a square tubular extension means extending from each of first and second parallel sides thereof, said square tubular extension means being aligned with each other and having a common longitudinal axis;

top horizontally disposed link means for interconnecting adjacent corner posts and intermediate posts, the end of said top horizontally disposed link means having extensions thereon for extending into said openings in said main housings of said corner posts and holes in said elongated housing in said intermediate posts;

bottom horizontally disposed link means for interconnecting with adjacent base members of said corner posts and base housings of said intermediate posts, said bottom horizontally disposed link means being telescopically connected on the ends thereof to the square tubular extensions on said base members of said corner posts and said base housing of said intermediate posts;

sheets of skirt material for extending completely around the bottom of a mobile home;

upper flange means extending outwardly and downwardly from said top horizontally disposed link means for receiving the top of said sheets between the top horizontally disposed link means and said upper flange means for preventing substantial lateral movement of said sheets when the top of said sheets are positioned between the top horizontally disposed link means and said upper flange means;

lower flange means extending outwardly and upwardly from said bottom horizontally disposed link means for receiving the bottom of said sheets between the bottom horizontally disposed link means and said lower flange means for preventing substantial lateral movement of said sheets when the bottom of said sheets are positioned between the bottom horizontally disposed link means and the lower flange means; and wherein the height of said sheets being more than the distance between the bottom of the upper flange means and the top of the lower flange means and less than the distance between the top of the upper flange means and the bottom of the lower flange means.

2. The apparatus of claim 1 wherein said sheets are constructed of wood.

3. The apparatus of claim 1 wherein said sheets are constructed of sheet metal.

* * * * *